US006685241B2

(12) United States Patent
Bollmann

(10) Patent No.: US 6,685,241 B2
(45) Date of Patent: Feb. 3, 2004

(54) CLOSING DEVICE FOR A WASHING MACHINE OR A CLOTHES DRYER

(75) Inventor: Andreas Bollmann, Adelberg (DE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/021,944

(22) Filed: Dec. 13, 2001

(65) Prior Publication Data

US 2002/0073744 A1 Jun. 20, 2002

(30) Foreign Application Priority Data

Dec. 14, 2000 (DE) ..... 100 62 458

(51) Int. Cl.[7] ..... E05B 15/02

(52) U.S. Cl. ..... 292/341.16; 292/216; 292/340; 292/341.15; 292/341.18; 292/DIG. 39; 292/DIG. 53; 292/DIG. 50; 292/DIG. 69

(58) Field of Search ..... 292/341.17, DIG. 69, 292/340, 341.15, 194, 11, 216, 341.12, 341.13, 341.18, 341.19, DIG. 40, DIG. 39, DIG. 53, DIG. 55, DIG. 60

(56) References Cited

U.S. PATENT DOCUMENTS

| | | | | | |
|---|---|---|---|---|---|
| 446,173 | A | * | 2/1891 | Hancock | 292/341.19 |
| 513,667 | A | * | 1/1894 | Buckingham | 292/341.18 |
| 1,676,515 | A | * | 7/1928 | Anstey | 292/78 |
| 1,888,829 | A | * | 11/1932 | Moore | 16/85 |
| 1,936,921 | A | * | 11/1933 | Strid | 292/340 |

FOREIGN PATENT DOCUMENTS

| | | | | |
|---|---|---|---|---|
| DE | 4317135 C1 | * | 9/1994 | |
| DE | EP 654556 A1 | * | 11/1994 | |
| DE | FR 2714106 | * | 12/1994 | |
| DE | 4424201 A1 | * | 1/1996 | |
| DE | EP 727178 A2 | * | 8/1996 | |
| DE | 19540843 A1 | * | 5/1997 | |
| DE | 196 36 925 A1 | | 12/1998 | ..... D06F/39/14 |
| FR | 1350994 | * | 2/1963 | |
| IT | EP 331643 A2 | * | 2/1989 | |
| IT | EP 533635 A1 | * | 9/1992 | |

OTHER PUBLICATIONS

European Search Report EP 01 12 1743, dated May 12, 2003.

*Primary Examiner*—J. J. Swann
*Assistant Examiner*—Carlos Lugo
(74) *Attorney, Agent, or Firm*—Thomas J. Roth; Robert O. Rice; John F. Colligan

(57) ABSTRACT

The invention concerns a closing device for a washing machine or clothes dryer with a machine door that locks a loading opening exhibiting a closing piston mounted onto the machine door hinged to the machine housing and a lock in the area of the loading opening, whereby the lock is provided with a latching element that brings the closing piston into a latching closed position when the machine door closes and releases it to an open position when the machine door is opened. An automatic adjustment of the closing piston to the latching element when the machine door closes is achieved in that the closing piston can be adjusted horizontally to a limited extent in the door rim, and that the closing piston with its nose is alignable with the latching element in a receiving element in the door frame around the loading opening.

(List continued on next page.)

7 Claims, 3 Drawing Sheets

U.S. PATENT DOCUMENTS 2,211,963 A * 8/1940 Strid ..... 292/99
2,592,274 A * 4/1952 Groeger ..... 292/332
2,833,578 A * 5/1958 Burke ..... 292/71
3,713,681 A * 1/1973 Worley ..... 292/78
3,912,311 A * 10/1975 Carvell et al. ..... 292/216
4,745,250 A * 5/1988 Mayo ..... 219/722
4,764,648 A * 8/1988 Resh ..... 200/50.1
5,517,006 A * 5/1996 Fredriksson et al. ..... 219/723
6,257,632 B1 * 7/2001 Jung et al. ..... 292/341.18
6,290,270 B1 * 9/2001 Spiessl ..... 292/226
6,327,879 B1 * 12/2001 Malsom ..... 70/97
6,340,182 B1 * 1/2002 Kaneda et al. ..... 292/102
6,390,518 B1 * 5/2002 Elick ..... 292/216
6,394,300 B1 * 5/2002 Bosy ..... 220/326

* cited by examiner

CLOSING DEVICE FOR A WASHING MACHINE OR A CLOTHES DRYER

BACKGROUND OF THE INVENTION

1. Field of the Invention

The invention concerns a closing device for a washing machine or a clothes dryer with a machine door that locks a loading opening and which has a closing piston mounted to the machine door hinged to the machine housing and a lock in the area of the loading opening, whereby the lock is provided with a latching element that brings the closing piston into a latching closed position when the machine door closes and releases it in an open position when the machine door is opened.

2. Description of the Related Art

There are various designs for such closing devices. The machine door can be held in the closed position by latching the closing piston in the lock during the running of the program until the washing drum comes to a stop.

However, as EP 0 533 635 B1 shows, the release of the look can also be brought about by an actuating element in the doorframe, e.g. a push button.

A closing device of the initially-cited kind is also disclosed in DE 43 39 621 C2 in which where the latching elements have one released or open position and two different closed positions. One of these closed positions is a pre-latched position that allows a demonstration of the machine with the opening and closing of the door, whereas the other closed position requires the machine to be electrically connected.

In particular for large loading openings and heavy machine doors, the disadvantage is that the closing element mounted on the machine door, be it a piston or a hook, depending on the tolerances of the coupling and the play of the machine door, does not reliably interact with the latching element of the lock in the door frame of the machine housing.

The problem of the invention is to create a closing device of the initially-cited kind that in a simple way brings about an automatic compensation of the tolerances and play between the closing element and the latching element without providing the closing device whit a complicated mechanism.

This problem is solved according to the invention in that the closing piston in the door rim is to a limited extent horizontally adjustable, and with its nose is alignable with the latching element in a receiving element of the door frame around the loading opening.

The closing piston with its limited horizontal adjustability in the door rim takes over the horizontal alignment, whereas with the outer contour of the closing piston the receiving element in the door frame effects not only the adjustment of the closing piston but also its vertical alignment and according raises or lowers the machine door to ensure the precise engagement between the closing piston and the latching element when the machine door is closed. This is achieved with simple parts: a separate closing piston and design of the receiving element thereof. The closing piston is already adjusted the first time the machine door hinged to the machine housing is closed. Another advantage of the new closing device is that the closing piston is easy to install and replace. The machine door is also sufficiently secure during transport.

SUMMARY OF THE INVENTION

According to one embodiment, the installation of the closing piston is facilitated in that the closing piston as a separate part can be snapped into the door rim and is to a limited extent adjustable with pins or fixings screws in horizontally aligned slots.

To achieve a precise adjustment of the closing piston and the latching element the nose is provided with a vertically aligned closing opening, and its outer contour and the receiving contour of the receiving element in the door frame are adapted to each other in such a way that when the machine door closes the closing piston is alignable with the latching element of the lock.

According to one embodiment, the releasable and adjustable position of the closing piston in the rim of the door is designed in such a way that the horizontal slots of the closing piston are on a fastening plate of the closing piston. The fastening plate is introduced with an L-shaped retention piece into a retention receptacle in the door rim and grips behind it, and catch spring on the fastening plate snaps into a catch receptacle in the door rim. Replacement of the closing piston is facilitated in that an actuating end of the spring sticks up extends through a hole in the fastening fixing plate of the closing piston and can be actuated from the rear of the machine door.

The machine door is locked and released according to an advantageous embodiment in that the latching element is designed as a catch with two stable positions that can be set and held with a tipping spring device. In the open position an actuating leg of the latching element extends into the movement path of the nose and in the closed position a latching leg of the latching element is inserted into the closing opening in the nose and held there.

To improve the operation of the lock, the latching element can also be hinged to a lever that is so arranged in the door frame as to pivot to a limited degree.

To improve safety, the machine can be equipped with a child lock that is characterized in that the door rim is provided with a child lock designed as an adjustable spacer which releases the machine door lock in one position and prevents the door from locking in the other position.

BRIEF DESCRIPTION OF THE DRAWINGS

The invention will be further explained with reference to the exemplary embodiment shown in the attached drawing in which.

DESCRIPTION OF THE PREFERRED EMBODIMENT

Figure 1:
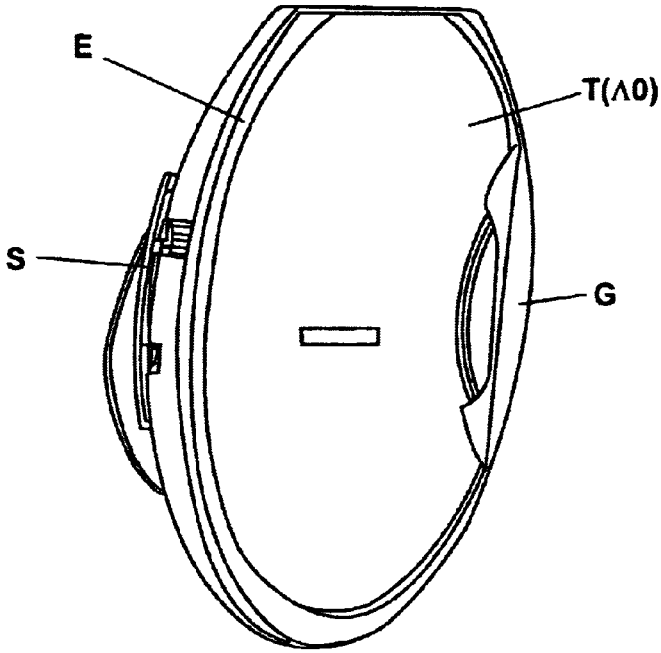
FIG. 1 is a perspective front view of a machine door.
Figure 2:
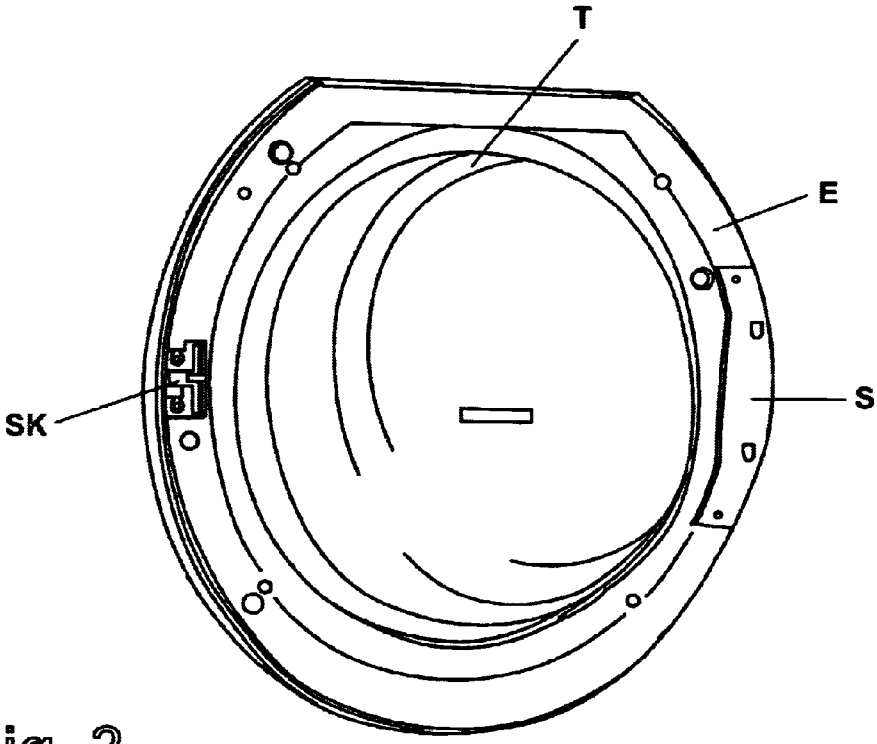
FIG. 2 is a perspective rear view of the machine door according to FIG. 1.

In FIG. 1, the machine door T is shown from the front. There is a hinge S in the area of the horizontal diameter on one side to hinge the door to a doorframe of the machine housing. The other side has a door handle G. E designates the door rim to the rear of which the hinge S and a closing piston SK are affixed as shown in FIG. 2. The closing piston SK extends from the back of the machine door T in such a way that a latching element in a lock that is situated in the door frame of the machine housing can be brought into interaction with the above closing piston.

Figure 3:
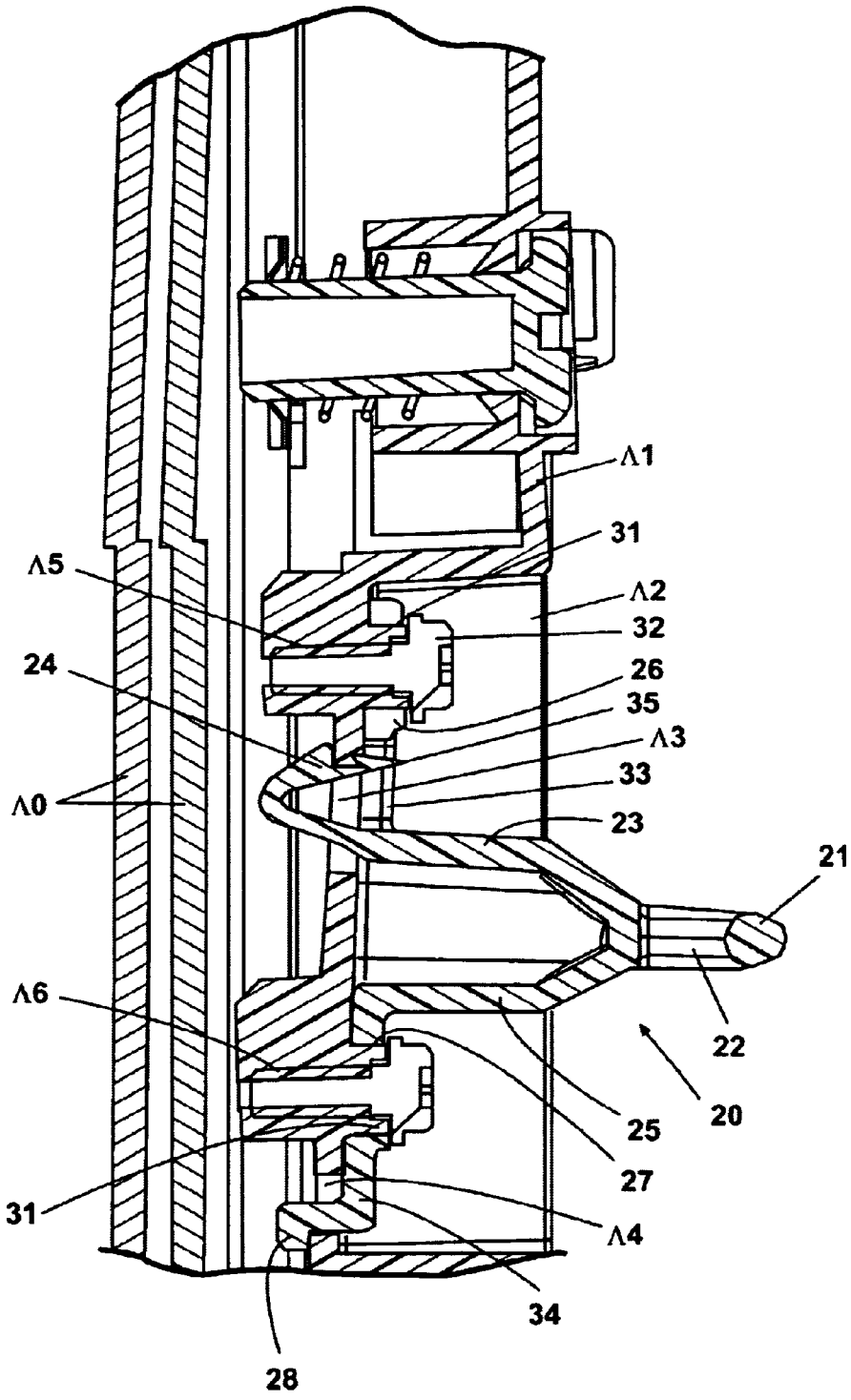
FIG. 3 is a partial cross section of the assembly of a closing piston in the rim of a machine door.

FIG. 3 shows the door 10, which can for example, be designed as a bull's-eye door and which is hinged to the door rim 11 in a usual manner. The doorframe 40 (FIG. 4) encloses the loading opening of the machine housing.

Shaped into the rear of the door rim 11 is a receptacle 12 in which a closing piston 20 is mounted as a separate component. At the free end facing the door frame 40 of the machine housing, the closing piston 20 transitions into a nose 21 that has a vertically aligned opening 22 for a latching element 60 in FIG. 4. Facing towards the front of the machine door 10, the outer contour of the closing piston 20 widens and is adapted to the inner contour of a receiving element 51. This receiving element 51 is mounted as a component 50 in a receptacle 41 in the door frame 40 on the machine housing, as can be seen from the screw sockets 42, and provides access to the latching element 60 of the lock.

As the cut parts 23 and 25 show, the closing piston 20 below the nose 21 is formed of a hollow body with a molded-on fastening plate 34. On one side, the fastening plate 34 ends in an L-shaped retention piece 28 that is guided through a retention receptacle 14 in the door rim 11 and held there. Molded on the opposite side of the retention piece 28 of the fastening plate 34 is a catch spring 24 that locks into a snap-in receptacle 13 in the door rim 11 and as an actuating end 35 extends out of a penetration 33 through the fastening plate 34 so that this snap-in connection is accessible and can be released from the rear of the machine door 10.

Figure 5:
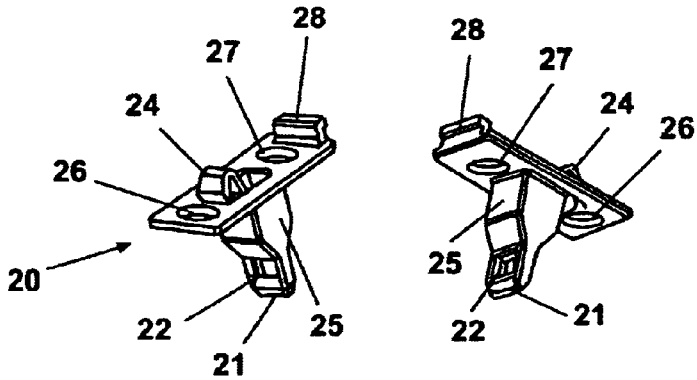
FIG. 5 shows two perspective views of the closing piston on a smaller scale.

As can be seen in FIG. 5 in the fastening plate 34 the closing piston 20 has two horizontally aligned slots 26 and 27 (perpendicular to the plane of the drawing in FIG. 3). The door rim 11 extends with pins 31 up into the slots 26 and 27 in the closing piston 20 so that it is to a limited extend adjustable. The closing piston 20 can also be secured to the door rim 11 by means of screws 32 which can be screwed into the screw holes 15 and 16 in the door rim 11 in the area of the pins 31.

When the machine door 10 closes, the closing piston 20 is inserted into the receiving element 51 on the door frame 40 of the machine housing and is automatically aligned in such a way that the nose 21 contacts the latching element 60 in the correct position.

Figure 4:
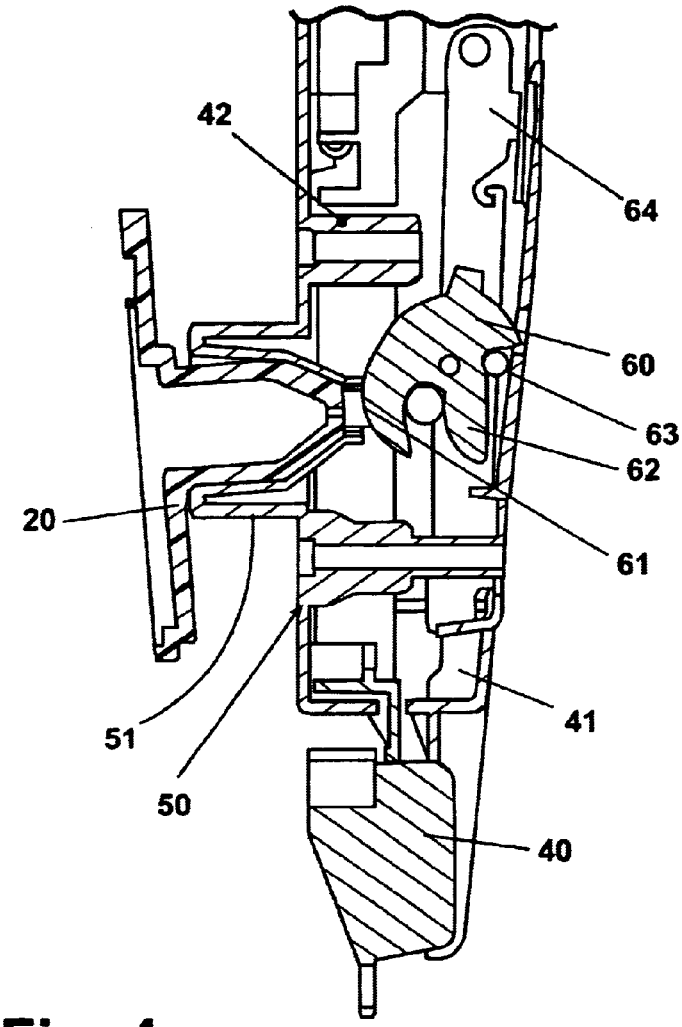
FIG. 4 is a partial cross section of the lock built into the door frame of the machine housing in the closed position with the closing piston.

The latching element 60 is designed as a catch with an actuating leg 62 and a latching leg 61 and is set and held bistably with a tipping spring device. In the open position, the latching element 60 in FIG. 4 is turned in a clockwise direction and held at a stop 63 so that the inserted and adjusted closing piston 20 contacts the actuating leg 62 with its nose 21 and swings the latching element 60 in a counter-clockwise direction. The tipping spring device sets the latching element in the other position in which the latching leg 61 is inserted into the closing opening 22 in the nose 21 and held there under spring tension. This pulls the machine door 10 and the door rim 11 against the doorframe 40.

When the machine door 10 is opened, the nose 21 is pulled out of the latching element 60, whereby the latching leg 61 is entrained, and the holding position of the latching element 60 is released. The latching element 60 returns into the open position and releases the nose 21.

To improve the locking and release of the nose 21, the latching element 60 is also hinged to a lever 64 that is pivoted in the door frame 40 as the bearing pin 65 shows.

What is decisive is that the closing piston 20 can be horizontally adjusted to a limited extent in the door rim 11, and that this adjustment is carried out automatically in relation to the tolerances and play of the involved components and assemblies when the machine door 10 is closed. Also contributing to this is the automatic adjustment between the outer contour of the closing piston 20 and the inner contour of the receiving element 51. In addition, the opening 33 in the nose 21 and the cross-section of the latching leg 61 of the latching element can be selected in such a way to facilitate and improve the insertion process and the final adjustment of the closing piston 20.

I claim:

1. A closing device for a washing machine or clothes dryer with a machine door that locks a loading opening having a closing piston mounted into a rim of the machine door, the machine door hinged to a machine housing and a lock at the loading opening, the lock provided with a latching element that brings the closing piston into a latching closed position when the machine door closes and releases it to an open position when the machine door is opened, wherein:

the closing piston as a separate part can be locked into place in the door rim and can be adjustable to a limited extent in the door rim with pins or fastening screws in horizontally aligned slots;

the slots in the closing piston are arranged in a fastening plate of the closing piston, the fastening plate is inserted with an L-shaped retention piece into a retention receptacle in the door rim and grips behind it, and a catch spring on the fastening plate is locked into place in snap-in receptacle in the door rim;

the closing piston further comprising a nose having an outer contour being alignable with the latching element in a receiving contour of a receiving element of a doorframe around the loading opening, the nose having a vertically aligned closing opening, and the outer contour of the nose and the receiving contour of the receiving element in the doorframe are adapted to each other in such a way that the closing piston is alignable with the latching element of the lock when the machine door closes.

2. The closing device according to claim 1, wherein:

with an actuating end the catch spring extends up through a penetration through the fastening plate of the closing piston and can be actuated from a rear of the machine door.

3. The closing device according to claim 2, wherein:

the latching element is designed as a catch with two stable positions that can be set and held with a tipping spring device, when the latching element is in the open position, an actuating leg extends into a movement path of the nose, and when it is in the closed position, a latching leg of the latching element is inserted into the closing opening of the nose and held there.

4. The closing device according to claim 3, wherein:

the latching element is hinged to a lever which can itself pivot to a limited degree in the doorframe.

5. A closing device for a washing machine or clothes dryer with a machine door that locks a loading opening having a closing piston mounted into a rim of the machine door, the machine door hinged to a machine housing and a lock at the loading opening, the lock provided with a latching element that brings the closing piston into a latching closed position when the machine door closes and releases it to an open position when the machine door is opened, wherein:

the closing piston in the door rim comprises slots arranged in a fastening plate of the closing piston, the slots being adapted to provide horizontal adjustability of the closing piston, the fastening plate comprising an L-shaped retention piece configured to be inserted into a retention receptacle in the door rim and grip behind it, and a catch spring configured to be locked into a place in snap-in receptacle in the door rim, the closing piston having a nose alignable with the latching element in a receiving element of a doorframe around the loading opening, and the closing piston being removably attachable to the door rim via snap engagement.

6. The closing device according to claim 5, wherein:

the closing piston as a separate part can be locked into place in the door rim and be adjustable to a limited extent in the door rim with pins or fastening screws in slots.

7. The closing device according to claim 5, wherein:

the nose has a vertically aligned closing opening, and the nose and the receiving element in the doorframe being adapted to each other in such a way that the closing piston is alignable with the latching element of the lock when the machine door closes.

* * * * *